United States Patent [19]

Bengeult

[11] Patent Number: 4,743,916

[45] Date of Patent: May 10, 1988

[54] METHOD AND APPARATUS FOR PROPORTIONAL RF RADIATION FROM SURFACE WAVE TRANSMISSION LINE

[75] Inventor: Greg A. Bengeult, Auburn, Wash.

[73] Assignee: The Boeing Company, Seattle, Wash.

[21] Appl. No.: 813,049

[22] Filed: Dec. 24, 1985

[51] Int. Cl.[4] ..... H01Q 13/00; H01Q 1/36

[52] U.S. Cl. ..... 343/785; 343/707; 343/790; 343/908

[58] Field of Search ..... 343/785, 705, 707, 773, 343/774, 790, 791, 898, 899, 908; 333/240

[56] References Cited

U.S. PATENT DOCUMENTS

| | | | |
|---|---|---|---|
| 2,178,299 | 10/1939 | Dallenbach | 250/11 |
| 2,192,532 | 3/1940 | Katzin | 250/33 |
| 2,311,535 | 2/1943 | Goldmann | 250/33 |
| 2,444,320 | 6/1948 | Woodward, Jr. | 250/33.53 |
| 2,486,597 | 11/1949 | Greene | 250/33 |
| 2,588,610 | 3/1952 | Boothroyd et al. | 343/785 |
| 2,737,632 | 3/1956 | Grieg . | |
| 2,770,783 | 11/1956 | Clavier et al. | 333/240 |
| 2,818,566 | 12/1957 | Rankin | 343/905 |
| 2,866,194 | 12/1958 | Stavis et al. | 343/725 |
| 2,867,776 | 1/1959 | Wilkinson . | |
| 2,929,065 | 3/1960 | Kreinheder | 343/785 |
| 2,993,205 | 7/1961 | Cooper | 343/771 |
| 3,087,157 | 4/1963 | Bogner | 343/785 |
| 3,155,975 | 11/1964 | Chatelain | 343/785 |
| 3,283,330 | 11/1966 | Chatelain | 343/785 |
| 3,290,626 | 12/1966 | Hafner . | |
| 3,509,463 | 4/1970 | Watkins . | |
| 3,566,317 | 2/1971 | Hafner | 333/240 |
| 3,588,754 | 6/1971 | Hafner | 333/21 R |
| 3,649,394 | 3/1972 | Erickson, Jr. | 156/16 |
| 3,699,582 | 10/1972 | Watts, Jr. | 343/739 |
| 3,914,767 | 10/1975 | Jones | 343/785 |
| 4,149,166 | 4/1979 | Null | 343/18 E |
| 4,197,546 | 4/1980 | Cachier et al. | 343/701 |
| 4,225,869 | 9/1980 | Lohrmann | 343/773 |
| 4,378,558 | 3/1983 | Lunden | 343/814 |

FOREIGN PATENT DOCUMENTS

| | | | |
|---|---|---|---|
| 1013720 | 8/1957 | Fed. Rep. of Germany | 343/807 |
| 2636523 | 2/1978 | Fed. Rep. of Germany . | |
| 2648375 | 4/1978 | Fed. Rep. of Germany | 343/785 |
| 573436 | 11/1945 | United Kingdom . | |
| 732827 | 6/1955 | United Kingdom | 343/785 |
| 146804 | 3/1959 | U.S.S.R. | 343/785 |

OTHER PUBLICATIONS

"Surface-Wave-Excited Arrays of Discrete Elements: Specific Structures", Unidentified Technical Manual, Section 16.6.

*Primary Examiner*—William L. Sikes
*Assistant Examiner*—Michael C. Wimer
*Attorney, Agent, or Firm*—Christensen, O'Connor, Johnson & Kindness

[57] ABSTRACT

In a system for launching RF energy as a traveling surface wave onto a single wire transmission line and causing such energy to be radiated away from the line at a downstream location, a series of window radiators of annular shape are spaced along the line, coaxial therewith, each for radiating a portion of the surface wave energy. Each radiator has a conductive component that causes decoupling and radiation of a portion of the RF energy, and a dielectric window that allows the remaining portion of RF energy to pass therethrough and continue, as an attached surface wave, downstream to a succeeding, similarly formed radiator where the decoupling and partial radiation occurs again. Thus, from the same surface wave transmission line system, it is possible to radiate RF energy from two or more discrete locations along the line.

19 Claims, 4 Drawing Sheets

Fig. 1.
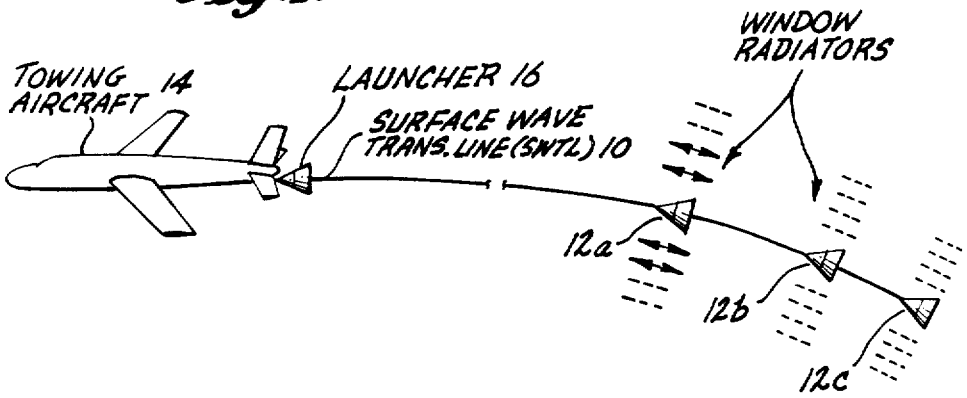
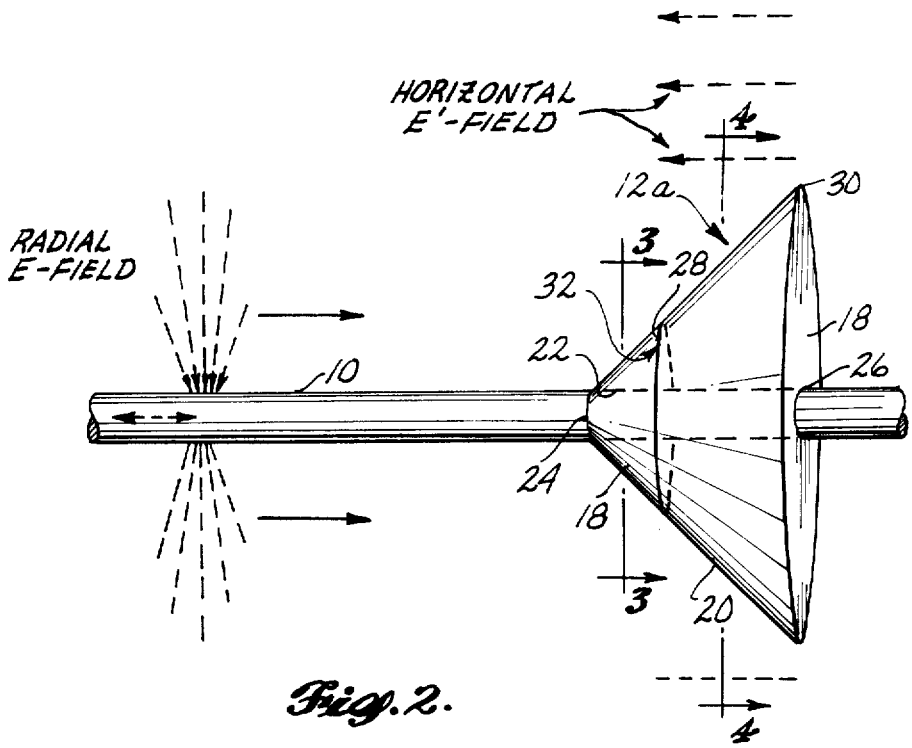
Fig. 2.

METHOD AND APPARATUS FOR PROPORTIONAL RF RADIATION FROM SURFACE WAVE TRANSMISSION LINE

BACKGROUND OF THE INVENTION

The invention relates to the radiation of RF energy from a surface wave transmission line.

Because of the low-loss characteristics of surface-wave transmission lines, including Goubau lines (also called G-lines), they are the preferred transmission line when environmental conditions accommodate the unique properties of a traveling surface wave. One such application, pertinent to the present invention, is the transmission of radio frequency energy along a line towed by an aircraft such that no intermediate supports are required along the line which might interfere and cause decoupling of the surface wave energy. A prior example of this use of a G-line is disclosed in U.S. Pat. No. 3,566,317, issued to Hafner, Feb. 23, 1971, wherein RF energy launched onto an end of the line attached to the towing aircraft is efficiently transmitted to the line's distal end where all of the RF energy is recaptured by a delauncher for use in a transmitter. In another application, the RF signal energy is transmitted along the towed line, efficiently without perceptable leakage, and then at a predetermined point along the line, all of the energy is radiated outwardly from the line by a drogue radiator. The latter system is disclosed, for example, in U.S. patent application, Ser. No. 225,698, filed Jan. 16, 1981, by Buehler for "Ventriloqual-Like Jamming of Radar."

SUMMARY OF THE INVENTION

In the present invention, a predetermined portion of the total RF energy traveling on a surface wave line is radiated from each of a plurality of annular radiators disposed coaxially and at selected intervals along the line. The radiated energy emanates from the discrete radiator locations which are not constrained to any particular spacing so long as the separation is greater than at least one wavelength of the transmitted RF energy. The radiating component of each radiator is an annular eletrical conductor, and at least the first of a series of such radiators has a window, such as a circular opening formed in the conductor. The conductor and circular opening therein are coaxially mounted on the transmission line by a dielectric material, transparent to the RF energy. The annular conductor and opening (window) therein, are sized and shaped so that a predetermined portion of the total RF wave energy incident on the radiator is decoupled and radiated outwardly from the line, and the remaining portion is caused to pass through the window in the annular conductor, undisturbed and still coupled (or as sometimes characterized "glued") as a surface wave to the transmission line. Downstream of the first window radiator, one or more additional window radiators may be disposed for again causing decoupling and radiating of a portion of the RF energy while allowing the remaining RF energy wave to continue on downstream. The last of a succession of radiators (including the second radiator where only two are used) may be a non-window radiator for decoupling and radiating all of the remaining surface wave energy. Thus, by adjusting the shape and size of each window radiator, a predetermined portion of the wave energy is radiated and a predetermined portion is passed on through, hence the term proportional radiation.

In a preferred embodiment, the window radiator is formed by a dielectric support in the shape of a cone having an axial bore through which the surface wave transmission line passes and a hollow frustoconical electrical conductor mounted on the dielectric support so that the smaller, truncated end of the frustoconical conductor faces forward on the line and defines a circular opening that forms the window. The conical configuration of both the dielectric support and the hollow frustoconical electrical conductor formed thereon create both the desired electrical radiation and pass-through transmission characteristics, as well as forming an aerodynamically stable drogue. Alternative embodiments include various solid surfaces of revolution generated by rotating different two-dimensional lines and curves around the axis of the line, resulting in such shapes as a half-sphere, a half-ellipsoid and flared or horn-shaped radiator surfaces.

To provide a complete disclosure of the invention, reference is made to the appended drawings and the following description of a preferred embodiment, as well as of certain alternative embodiments.

BRIEF DESCRIPTION OF THE DRAWINGS

FIG. 1 is a schematic view of the radio frequency transmission and radiation system in accordance with a preferred embodiment of the invention showing a surface wave transmission line towed by an aircraft and having a plurality of window radiators attached to the line at intermediate locations therealong:

FIG. 2 is an enlarged, isometric view of one of the window radiators of FIG. 1 mounted on the surface wave transmission line;

DETAILED DESCRIPTION

Figure 3:
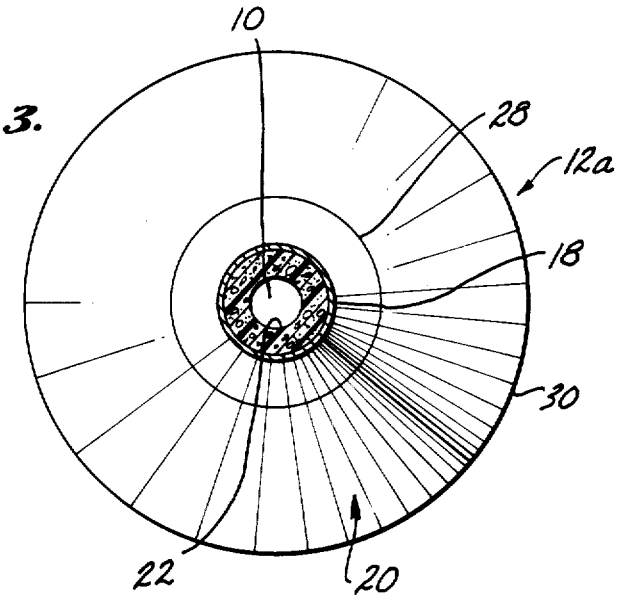
FIGS. 3 and 4 are sectional views of the window radiator of FIG. 2 taken transversely through the Figure at lines 3—3 and 4—4.
Figure 4:
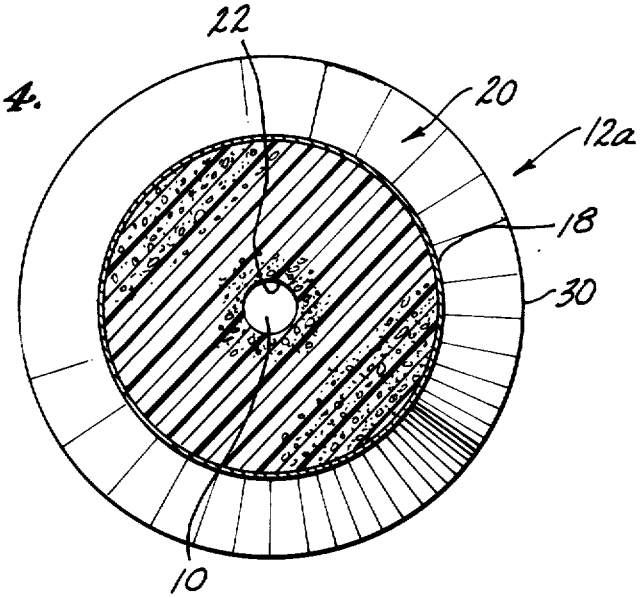

With reference to FIG. 1, the preferred embodiment of the radio frequency transmission and radiation system of the invention is shown to include a surface wave transmission line 10 on which a series of window radiators 12*a*, 12*b* and 12*c* are mounted, each shaped as a drogue for aerodynamically stable flight, and each constructed for proportional radiation. A leading end of line 10 is connected to aircraft 14 so as to be towed thereby, and radio frequency energy that is to be dispersed by radiators 12*a*, 12*b* and 12*c* is launched onto the leading end of line 10 by a launcher 16 mounted adjacent the aircraft's tail end. In accordance with the principles of surface wave transmission lines, and in particular Goubau lines, launcher 16 effectively causes the radio frequency energy to be coupled onto the single wire conductor as a traveling bundle of wave energy, with the electrical field oriented normal to the axis of the line. The succession of window radiators 12*a*, 12*b* and 12c causes controlled portions of the total upstream RF wave energy on line 10 to be decoupled and radiated outwardly from the line at the location of each radiator, while causing a remaining portion of the energy to remain attached, or as sometimes stated "glued," to line 10 until encountering another radiator downstream. The spacing along the line 10 the pluraility of radiators 12a, 12b and 12c is not constrained to any particular dimension so long as the separation is at least substantially greater than one wavelength of the transmitted RF energy. As such each radiator appears to produce a discrete point source of RF energy.

The number of such serial window radiators is theoretically unlimited, however, practical considerations indicate that two to five radiators will normally be used, given the finite amount of energy that is capable of being transmitted along the line 10, and hence available for being dispersed. While at least the first of a series of radiators must have the window in order to allow a portion of the energy to pass through, the last, which may be the second radiator, can be of a non-window type so as to cause the residual energy on the line to be completely radiated at that point.

In FIG. 2, an enlarged, isometric view of the first window radiator 12a is representative and is shown to include a conical dielectric support 18 and a conforming frustoconical conductor 20. Dielectric support 18 has an axial through-bore 22 sized to fit snugly about the exterior surface of line 10 and in the preferred embodiment, support 18 is adhesively bonded to line 10 at a preselected intermediate location therealong. While dielectric support 18 may be made of any dielectric substance that is substantially transparent to the particular band of RF energy to be transmitted, in the preferred embodiment, support 18 is an expanded polystyrene foam with a density of four pounds per cubic foot. The conical body of support 18 may be carved from a block of foam material, and, as indicated in FIG. 2, except for through-bore 22, support 18 fills the conical space between the leading and trailing axial ends 24 and 26.

The frustoconical conductor 20 of radiator 12a is provided by a conductive layer, such a copper or silver foil, formed onto the exterior conical surface of support 18 beginning at an axial end 28 spaced from the leading support end 24 and continuing to a trailing axial end 30 lying in the same transverse plane as support end 26. The conductor is thus thin-walled and forms at end 28 an iris-like, circular window 32 coaxial with line 10 through which a predetermined portion of the RF surface wave energy passes through and downstream of radiator 12a. The forward concial portion of support 18, extending from support end 24 to end 28 of conductor 20, is electrically inert bu serves as an aerodynamic fairing together with the supported conductor 20 for stable flight when towed as illustrated in FIG. 1.

Although the expanded polystyrene foam support 18 may be secured to line 10 in various ways and by different materials that are transparent to the RF energy, one preferred technique is to form the conical body of expanded polystyrene with an axial opening that is somewhat larger than the exterior diameter of line 10. After conductive foil, for example an adhesive-backed copper foil tape, is wrapped onto support 18 to form the hollow, frustoconical conductor 20, then the entire structure is affixed to the transmision line by using a conventional, two-part foam-in place polyurethane between the oversized interior bore of support 18 and the exterior surface of transmission line 10. The polyurethane foam serves both as a filler and to adhesively bond the support to the line at the desired location. The polyurethane foam is like the expanded polystyrene foam of structure 18, transparent to most frequencies of RF energy, including the X-band microwave energy used in one application of this embodiment.

In operation, as RF energy travels along line 10 the electric field vectors (E-field) are oriented radially as indicated in FIG. 2. The traveling bundle of RF energy is tightly coupled or "glued" to the line such that it is efficiently transmitted therealong unless an obstacle or aberration is encountered which causes the energy to be decoupled and dispersed. When this traveling wave encounters window radiator 12a, in accordance with the principles of the invention, a predetermined portion of the traveling wave energy is caused to pass through window 32 and radiator 12a while the balance of the energy reacts to the frustoconical conductor 20 and is decoupled and radiated outwardly from the line as indicated.

In this preferred embodiment, the conductor 20 is a 45° frustum and thereby causes the radiated portion of the energy to be redirected outwardly in a radial pattern with the radiated E'-field lines oriented parallel to the axis of line 10 resulting in horizontal polarization. Carefully sizing the iris-like window 32 that separates the leading edge 28 of conductor 20 from the outer surface of line 10 causes a predictable and hence controlled portion of the total energy incident on window radiator 12a to pass uncorrupted on through the radiator location without being detached from the line. Hence, the pass-through portion of energy on line 10 is allowed to propagate downstream to the next successive radiator where the process is repeated.

It is observed that the separation of the radiators along the line 10, such as radiators 12a and 12b in FIG. 1, is not constrained to any particular dimension so long as the spacing is substantially greater than the wavelength of the transmitted RF energy. Such unconstrained spacing of the window radiators causes the radiated energy to appear, when monitored at a distance, as though originating from separate, discrete sources, rather than as coming from a single coherent source, as in the case of conventional, multi-element antennas having uniform, close spacing at predetermined multiples of the quarter wavelength.

Figure 5:
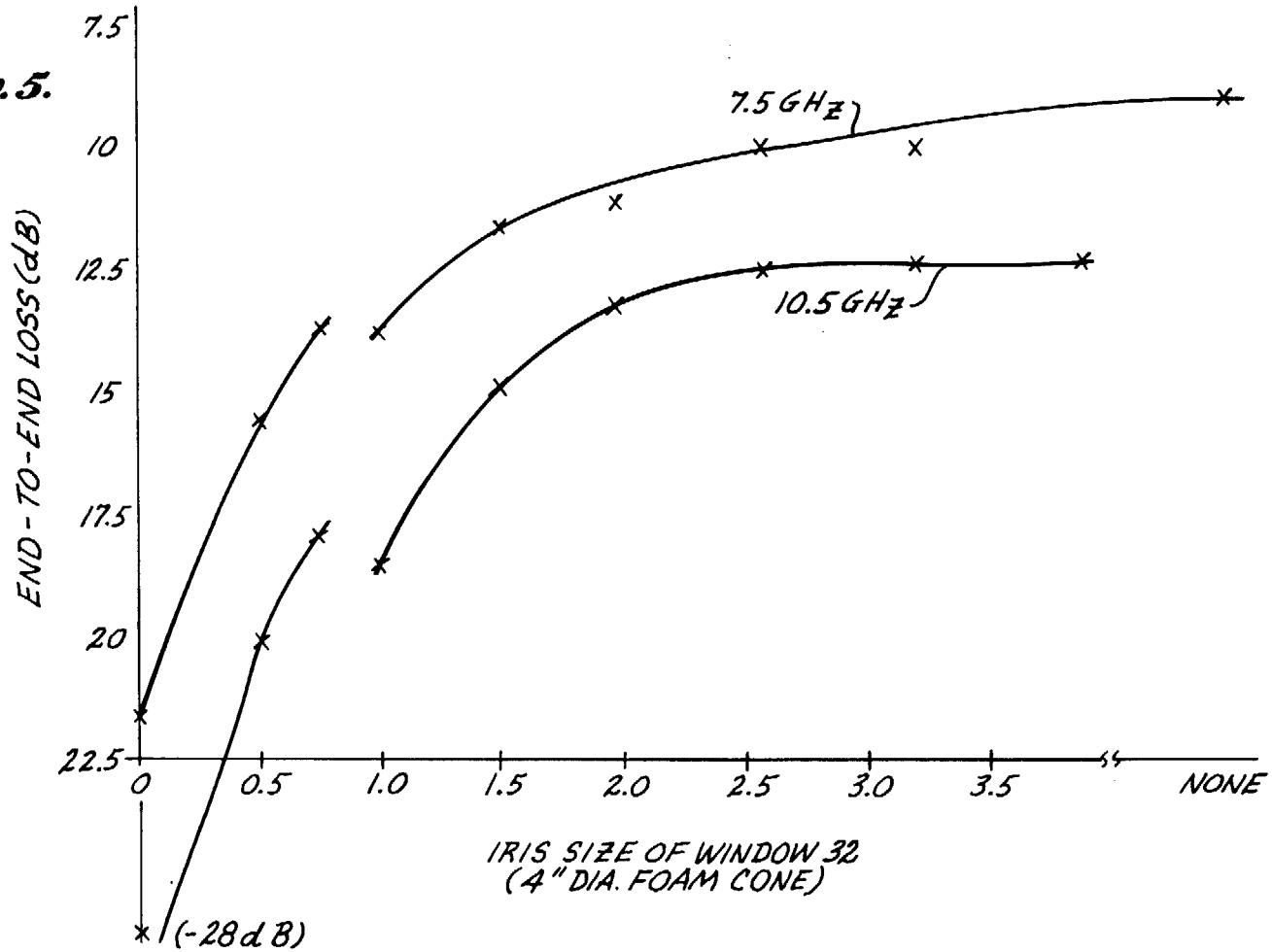
FIG. 5 is a graph, plotted at two different frequency bands, showing the proportion of RF energy radiated by the window radiator as a function of the window size for a 45° conical window radiator.

With reference to FIG. 5, the relationship of end-to-end loss of a 45° frustoconical window radiator, such as shown in FIG. 2, is plotted against window size, e.g., the diameter of the iris-like window 32 as shown in FIG. 2. The upper plot is for RF energy at 7.5 gigahertz, while the lower plot is for frequencies at 10.5 gigahertz. As indicated, there is a proportional, although not linear, relationship between the size of window 32 (diameter of the iris-like opening at the truncated end 28 of the frustoconical conductor 20) and the amount of RF energy that is caused to pass on through the window radiator. The loss in units of dB represents the energy that is not passed through the radiator but rather is decoupled and radiated away from the line as described above in connection with FIG. 2. As expected, the smaller the iris size of window 32, the greater the loss as a larger portion of the upstream energy is reflected at the radiator. As the window size increases out to the maximum downstream diameter of the conductive cone, the percentage of end-to-end loss in dBS levels out to a range of roughly 12 to 8 dBs depending upon the frequencies involved. It will be appreciated that these plotted relationships are but for one particular size window radiator shape, namely a 45° frustum as depicted in FIG. 2, with a maximum diameter at the trailing axial end 30 of four inches.

In dimensioning the windows for a series of cascaded window radiators 12*a*, 12*b* and 12*c* as shown in FIG. 1, the window size is selected as above to radiate at each location a desired portion of the incident RF energy. Thus, the windows may be of progressively smaller size in those applications where it is desired to radiate at each location an equal level of energy given the progressively decreasing amount of available energy on line 10 after partial radiation at each window radiator. On the other hand, the window radiators may have the small sized windows in those applications where it is desired to radiate the same proportion of available surface wave energy, even though it is progressively decreasing. Also as mentioned, the last radiator in a series, which may be the second, can be a non-window, conventional radiator to cause the residual energy on the line to be completely radiated.

ALTERNATIVE EMBODIMENTS

Figure 6:
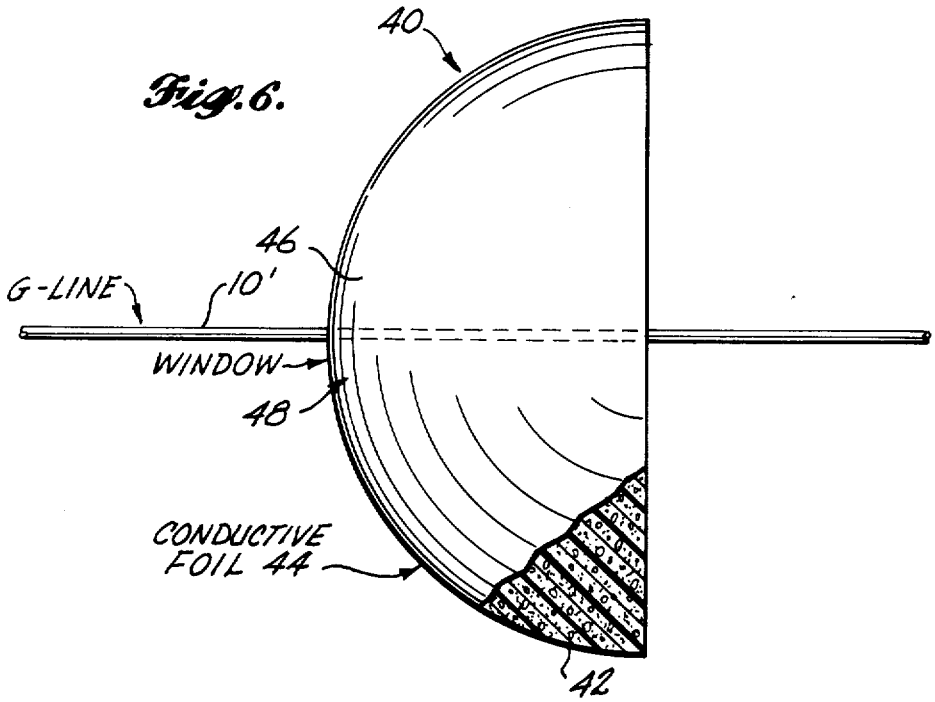
FIG. 6 is a plan view of an alternative geometry for the window radiator, namely a half-sphere.

In FIG. 6, the foregoing principles are applied to produce a window radiator 40 having hemispherical shape rather than conical. Again, the dielectric support 42 may be an expanded polystyrene foam shaped to support a foil conductor 44 in the configuration of a hollow, half-sphere with a circular cutout opening 46 defining an iris-like window 48 coaxial with transmission line 10'. The hemispherical shape of the foil conductor 44, when formed on support 42, more uniformly disperses the radiated energy forward and rearward as well as radially, compared to the 45° frustocone shape of the above-described embodiment of FIG. 2 which reflects the energy in primarily the radial plane.

Figure 7:
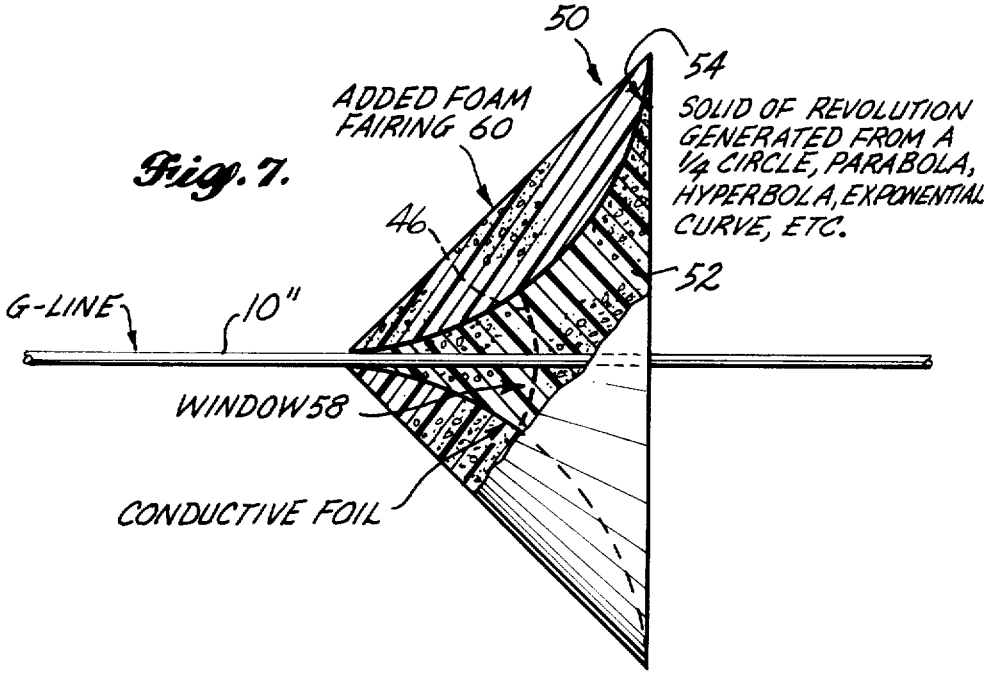
FIG. 7 is a plan view, partly in section taken parallel to the line axis, showing another alternative geometry of the radiator that has an additional dielectric fairing which covers the conductive radiator and window area.

A further alternative embodiment is shown in FIG. 7 in which window radiator 50 has a dielectric support 52 and a foil conductor 54 formed thereon in the shape of a solid revolution generated from a quarter circle, the center of which is on the opposite side of the curvature from the axis of transmission line 10". The result is a horn shape, flaring outwardly in a downstream direction. This configuration produces a distributed energy pattern that is different from the hemispherical conductor of the embodiment shown in FIG. 6, and again has a more uniform distribution pattern than exhibited by the 45° frustum of the embodiment in FIG. 2. The solid of revolution formed by support 52 and foil conductor 54 of window radiator 50 in FIG. 7 is shown as an example only, and it will be apparent that other distrubtion patterns may be produced by solids of revolutions generated from two-dimensional parabola, hyperbola, exponential curves and other two-dimensional line segments.

In manufacturing a window radiator of the type shown in FIG. 7, it is preferable to first form dielectric support 52 into a desired shape. In the case of window radiator 50, the dielectric support 52 is carved from a block of polystyrene foam into the horn shape illustrated such that the smaller taper end extends all the way down to the size of the exterior diameter of the transmission line 10". The foil conductor 54 is then formed onto the exterior surface of horn-shaped structure 52 between truncation 46, defining window 58, and the downstream axial extent of structure 52 as depicted. The horn-shaped structure, which is now electrically complete, is mounted on the transmission line as described above in connection with the embodiment of FIG. 2. Preferably, a foam fairing 60 is added to achieve a more aerodynamically stable radiator. As mentioned above, each of the described radiators, when used in the application illustrated in FIG. 1, functions also as a drogue for stable flight when the line and radiators are towed by an aircraft. For this purpose, an electrically inert (RF transparetn) foam fairing 60 is applied by a molding process to fill in the flared region of support 52 and foil conductor 54, to form a regular cone for aerodynamic purposes.

While only particular embodiments have been disclosed, it will be readily apparent to persons skilled in the art that numerous changes and modifications can be made thereto, including the use of equivalent means and devices without departing from the spirit of the invention.

The embodiments of the invention in which an exclusive property or privilege is claimed are defined as follows:

1. A radio frequency transmission and radiation system comprising:

a surface wave transmission line adapted for transmission of a radio frequency surface wave along said line;

an annular electrically conductive radiator extending outwardly from and surrounding a predetermined length of said surface wave transmission line; said annular electrically conductive radiator having a first end region upon which said radio frequency surface wave impinges, at least a portion of said first end region increasing in cross-sectional area relative to distance along said surface wave transmission line taken in the direction in which a radio frequency surface wave travels along said surface wave transmission line said first end region including a surface wave transmitting window through which said surface wave transmission line passes, said surface wave transmitting window being dimensioned for passage of a predetermined portion of the energy in a radio frequency surface wave transmitted along said line with said predetermined portion remaining coupled to said line, said annular electrically conductive radiator radiating substantially all of said energy other than said predetermined transmitted portion; and, dielectric support means for supporting said annular electrically conductive radiator in coaxial spaced-apart relationship with said surface wave transmission line.

2. The system of claim 1, wherein said annular radiator is of frustoconical shape and includes an axial opening that defines said surface wave transmitting window.

3. The system of claim 1, wherein said surface wave transmission line is a Goubau line.

4. The system of claim 2, wherein said dielectric support means comprises a body formed of dielectric material transparent to said radio frequency surface wave, and disposed within said axial opening of said frustoconical shaped radiator and having an axial through-bore sized to substantially conform to the circumference of said transmission line.

5. The system claim 2, wherein said dielectric support means is a body made of dielectric material and having a first body region mated to fit within said axial opening of said radiator and having a second body region shaped and dimensioned to provide a conforming conical extension of the frustconical shape of said a radiator, and wherein said body has an axial through-bore sized to matingly receiving said transmission line.

6. The system of claim 5, wherein the first body region of said dielectric support means comprise a frustoconical exterior support surface and said frustoconical radiator comprises a layer of elecrtrically conductive material formed onto said frustoconical exterior surface of the first body region of said dielectric support.

7. The radiator of claim 2, wherein said annular radiator is of a frustoconical shape and includes an axial opening and wherein said dielectric support means comprises a body made of dielectric material and disposed within said axial opening of said radiator, said body made of dielectric material having an axially through-bore formed therein adapted for matingly receiving a surface wave transmission line.

8. The radiator of claim 7, wherein said body of dielectric material comprises a portion that extends axially from said frustoconical shape radiator at the smaller diameter end therof and said portion has itself a conical shape conformingly dimensioned and arranged relative to said frustoconical shape radiator so as to form a conical continuation of said frustoconical shape radiator.

9. The radiator of claim 7, wherein said dielectric support means comprises a body made of dielectric material and having a frustoconical exterior surface, and said radiator comprises a layer of electrically conductive meaterial formed on to said frustoconical exterior surface of said body of dielectric material.

10. A radiator and a surface wave transmission line comprising:

a radiating annular electrical conductor disposed along a length of a surface wave transmission line and remote from a surface wave launcher and having a shape that corresponds to a surface of revolution that is defined by rotation of a two-dimensional line segment about a predetermined axis, said annular electrical conductor including a surface wave transmitting window through which said predetermined axis extends; and dielectric support means adapted to support said annular electrical conductor in coaxial spaced-apart relationship with said surface wave transmission line that extends through said surface wave transmitting window and along said predetermined axis with said surface wave transmission line being spaced apart from boundaries of said surface wave transmitting window such that surface waves radiated from said launcher and traveling along said surface wave transmission line are partially detached from said transmission line and radiated outwardly therefrom by said electrical conductor and are partially transmitted through said surface wave transmitting window to continue along said surface wave transmission line as an attached surface wave.

11. The radiator of claim 10, wherein said annular electrical conductor is of a hemispherical shape.

12. The radiator of claim 10, wherein said line segment is a quarter circle.

13. The radiator of claim 10, wherein the line segment is a parabola.

14. The radiator of claim 10, wherein the line segment is a hyperbola.

15. The radiator of claim 10, wherein the line segment is an exponential curve.

16. The radiator of claim 10, wherein said annular electical conductor comprises a foil of conductive metal conformingly bonded to an exterior surface of said dielectric support means.

17. The radiator of claim 16, further comprising an aerodynamic fairing made of a dielectric material bonded to an exterior surface of said foil.

18. A radio frequency transmission and radiation system comprising:

a Goubau line for surface wave transmission of electromagnetic energy from a first end of said Goubau line toward a second end of said Goubau line; and, a plurality of annular radiators, each disposed coaxially on said Goubau line, said annular radiators for radiating electromagnetic energy traveling along said Goubau line and being spaced apart form one another by a distance substantially greater than one wavelength; at least the annular radiator located nearest said first end of said Goubau line including an electromagnetic transmissive window for passage of a portion of the incident electromagnetic energy for continued transmission toward said second end of said Goubau line, the portion of said electromagnetic energy not passing through said electromagnetic transmissive window being radiated away from said Goubau line; said Goubau line passing through said electromagnetic transmissive window and being spaced apart from the boundaries of said electromagnetic transmissive window.

19. The radio frequency transmission and radiation system of claim 18, wherein at least all of said annular radiators other than the annular radiator located nearest said second end of said Goubau line include an electromagnetically transmissive window and wherein each annular radiator that includes an electromagnetic transmissive window comprises:

an annular electrical conductor having an axial opening that defines the boundaries of said electromagnetic transmissive window; and, dielectric support means for supporting said annular electrical conductor coaxially about said Goubau line with said Goubau line passing through said axial opening.

* * * * *